United States Patent [19]

Crespi

[11] Patent Number: 4,738,340

[45] Date of Patent: Apr. 19, 1988

[54] SUITCASE STRUCTURE WITH COMPARTMENTS ACCOMMODATING SUITS AND THE LIKE

[75] Inventor: Carlo Crespi, Milan, Italy

[73] Assignee: Selman di Crespi Carlo & Co. S.n.c., Milan, Italy

[21] Appl. No.: 776,277

[22] Filed: Sep. 16, 1985

[30] Foreign Application Priority Data

Sep. 28, 1984 [IT] Italy ..... 23391 B/84

[51] Int. Cl.[4] ..... A45C 5/12; A45C 5/14; A45C 13/26; B65D 85/18

[52] U.S. Cl. ..... 190/18 R; 190/18 A; 190/109; 190/111; 190/112; 190/115; 206/279; 206/289

[58] Field of Search ..... 190/3, 13 R, 18 R, 18 A, 190/108–111; 206/279, 289, 290, 291

[56] References Cited

U.S. PATENT DOCUMENTS

| | | | |
|---|---|---|---|
| 1,147,918 | 7/1915 | Bartlett, Jr. | 190/13 R |
| 1,180,496 | 4/1916 | Heilman | 190/13 R |
| 1,536,425 | 5/1925 | Davis | 190/13 R |
| 1,818,525 | 8/1931 | Perez | 190/3 |
| 1,845,822 | 2/1932 | Wheary | 190/13 R |
| 2,552,438 | 5/1951 | Kramer | 190/111 |
| 2,605,989 | 8/1952 | Luft | 190/12 A X |
| 4,036,336 | 7/1977 | Burtley | 190/18 A |
| 4,122,925 | 10/1978 | Schultheiss | 190/108 |
| 4,156,480 | 5/1979 | Darbonnier | 190/111 |
| 4,163,484 | 8/1979 | Delaney | 190/18 R |

*Primary Examiner*—Stephen Marcus
*Assistant Examiner*—Sue A. Weaver
*Attorney, Agent, or Firm*—Guido Modiano; Albert Josif

[57] ABSTRACT

The suitcase structure comprises a substantially parallelepipedal, flattened elongate body defining at a smaller lateral face thereof a recess provided on the bottom with a handgrip for carrying the suitcase. At the larger faces of the body there are provided openable side bodies defining on their interiors compartments, provided at the top with hanger holding rods for hanging clothes hangers thereon.

9 Claims, 2 Drawing Sheets

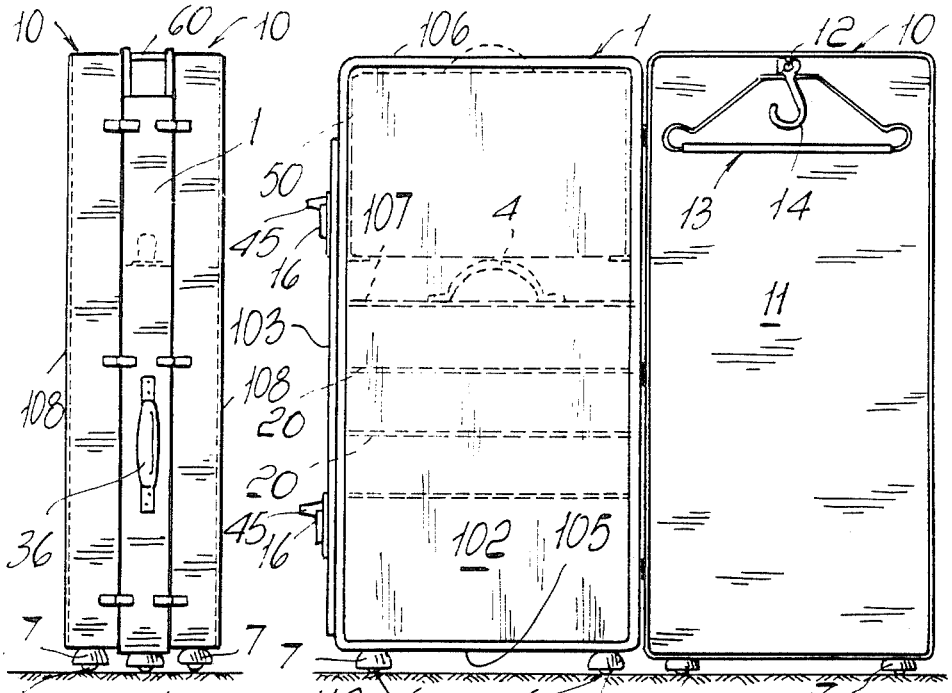
Fig.4
Fig.3
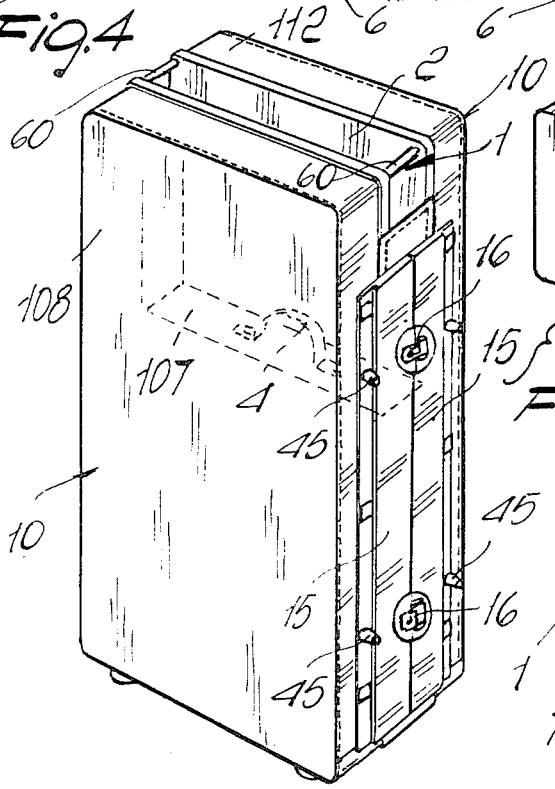
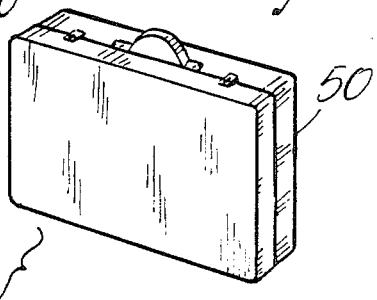
Fig.1
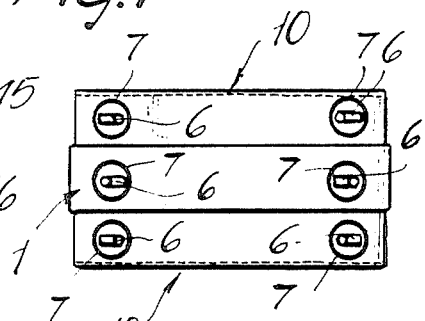
Fig.5

SUITCASE STRUCTURE WITH COMPARTMENTS ACCOMMODATING SUITS AND THE LIKE

BACKGROUND OF THE INVENTION

The present invention relates to a suitcase structure with compartments for accommodating suits and the like.

Suitcases traditionally comprise a body of box-like shape which can be closed, at a larger face thereof, by a lid element which can be closed and joined to the body by means of hooks, zip fasteners, and so forth.

Suitcases, which are formed from the most diverse of materials, such as plastics, leather, and so forth, are unable at present to provide for a rational disposition of suits on their interior, and suits and cloths placed into a suitcase are unavoidably apt to become crumpled and rumpled, creating problems especially to persons who are to travel extensively on account of their job or else, and require that their clothes can be worn at short notice.

In an attempt to obviate this disadvantage, U.S. Pat. No. 4,156,480 discloses a type of suitcase which comprises essentially two half-bodies of substantially flattened and elongate configuration, which are hingedly connected to each other.

In the mid-region delimited by the half-bodies, there is provided a cutout at the bottom whereof is provided a handle for carrying the suitcases suspended without its lower end touching the ground, thus facilitating its transportation.

This approach, which is quite satisfactory for some aspects, has shown to be inconvenient especially because the introduction of suits for hanging therein is relatively complicated, while the suitcase is awkward to carry around because the handle for holding it suspended, being connected to one of the half-bodies, cannot be located on the center of gravity of the suitcase.

Another disadvantage is that with such a suitcase, the only elements which can find proper disposition are the hanging clothes, and other personal belongings find no set placement within the suitcase.

SUMMARY OF THE INVENTION

It is, accordingly, the aim of this invention to provide a solution to the problem outlined above by providing a suitcase structure which, while affording in practice a plurality of separate useful volumes, also enables suits and clothes to be carried in an orderly fashion, with the suits being suspended and other belongings being afforded appropriate storage areas.

Within the above aim, it is a particular object of the invention to provide a suitcase which may be converted, in a sense, into a small wardrobe whence clothes and other required items can be individually removed as and when required without previously taking them out of the suitcase.

Another object of this invention is to provide a suitcase structure which can be easily carried like a traditional suitcase of a large size, without any difficulties and even in a facilitated way.

A not least object of this invention is to provide a suitcase structure which can be made in any shapes and of any materials traditionally utilized in suitcase manufacture.

The above aim, and these and other objects which will become apparent hereinafter, are achieved by a suitcase structure with compartments for accomodating suits and the like therein, according to the invention, comprising a substantially parallelepipedal, flattened, elongate body, defining at a lateral face thereof a recess provided on the bottom with a handgrip for carrying the suitcase suspended therefrom, at the larger faces of said body there being provided openable side bodies defining on their interiors compartments provided at the top with hanger holding rods for hanging suits and the like therefrom.

BRIEF DESCRIPTION OF THE DRAWINGS

Further features and advantages will be apparent from the following detailed description of a suitcase structure according to the invention, with reference to the accompanying illustrative and not limitative drawings, where:

FIG. 1 is a schematic perspective view illustrating the suitcase closed and in its carrying position;

FIG. 3 shows the suitcase in elevation with one side body opened;

FIG. 4 is a side elevation view of the suitcase;

FIG. 5 shows the suitcase as viewed from the remote end from the gripping and suspending end.

DESCRIPTION OF THE PREFERRED EMBODIMENTS

Figure 2:
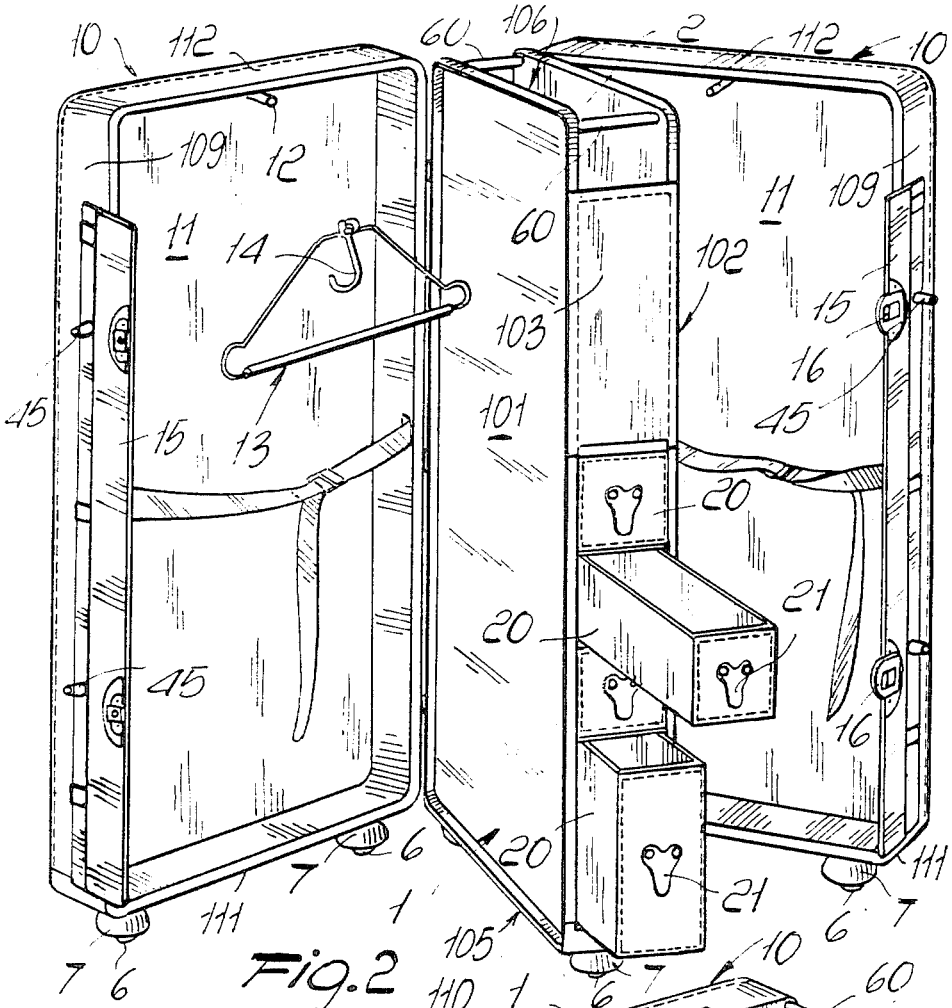
FIG. 2 is a perspective view of the suitcase in its open condition.
Figure 6:
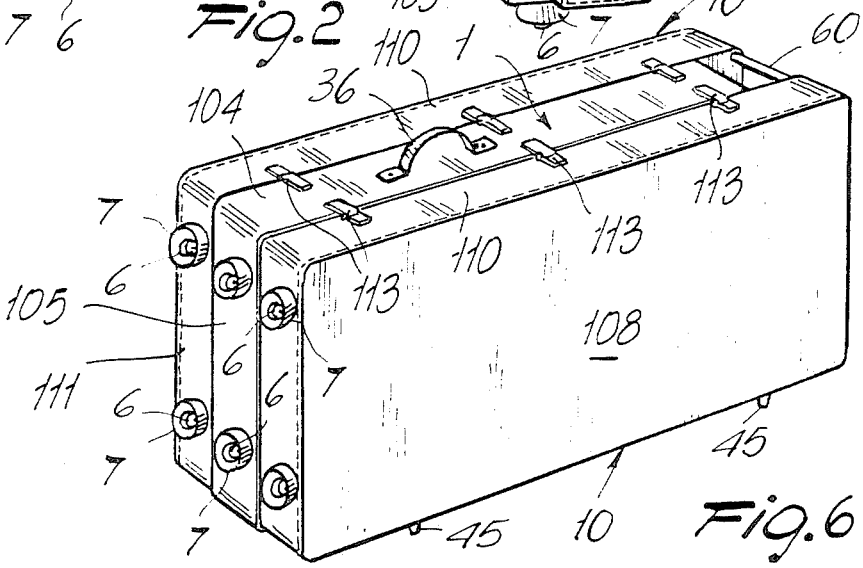
FIG. 6 is a turned over perspective view of the suitcase illustrating its auxiliary handgrip.

With reference to the drawing figures, a suitcase structure with compartments for accommodating suits and and the like therein, according to the invention, comprises a body or mid-body of substantially parallelepipedal, flattened, and elongate shape, generally designated with the reference numeral 1. As visible from the drawings, the mid-body 1 defines first and second opposite, substantially parallel larger walls defining first and second, opposite, substantially parallel larger faces 101 and 102, a front wall defining a front face 103, extending between the larger faces, at substantially at right angle thereto, a rear wall defining a rear face 104 extending between the larger faces 101, 102 substantially parallel and opposite to the front face 103, a rest face 105 extending among the faces 101–104 substantially at right angle thereto, and a recessed face 106 substantially parallel and opposite to the rest face 105. As visible, the larger walls extend from the recessed to the rest faces 106, 105.

At a smaller side face or lateral recessed face 106 of the body 1, there is defined a recess 2 which may span the entire mid-body 1, or alternatively only part of it as explained hereinafter, and has on its bottom wall 107 a handgrip, indicated at 4, which permits one to transport the suitcase suspended therefrom. In particular, as visible, the front and rear walls of the mid-body 1 extend from the rest face 105 toward the recessed face 106 and terminate at a distance from the depressed bottom wall 107, thereby the recess 2 is comprised between the larger, from the rear walls.

Specifically the body 1, which has an elongate parallelepipedal form may be carried in a substantially vertical upright position.

At the larger faces 101, 102 of the body 1, on either or both sides of the suitcase, there are provided openable side bodies, indicated at 10, which advantageously spand the full length of the larger face of the body 1 and define on their interiors compartments 11 having at the top a rod 12 for holding hangers 13 which are advantageously provided with a tilt-out suspension hook 14, thereby affording improved utilization of the available space. In detail the side bodies 10 have each a lateral large face 108 substantially parallel, in the closed condition of the suitcase to the larger faces 101, 102 and four side faces arranged substantially at right angle to the lateral face 108. In particular the side faces define a front wall 109, a rear wall 110, a rest wall 111 and a suspension wall 112 substantially aligned, with closed suitcase, to the front face 103, the rear face 104, the rest face 105, and the recess face 106 respectively. The rear walls 110 of the side body are hinged to the rear face 104 of the mid-body 1 through hinge means, indicated in the drawings at 113.

Thus, a suitcase is provided which expediently has three substantially discrete volumes, namely a middle volume to which two volumes are hingedly connected which are formed by the openable bodies and may have varying depths, with a metal frame covered with hide, cloth, and the like, or alternatively rigid shells.

On the smaller side faces, of both the mid-body 1 and side bodies 10, remote from the area formed with the recess 2, there are provided small wheels, casters or caster pairs 6 which would be advantageously enclosed within a bell-like body 7 of rubber or some other compliant material serving to protect the casters 6, against accidental damage.

With the arrangement just described, one can put in the suitcase of this invention two or more suits, into each compartment, depending on the depth of the side bodies, to keep them hanging even during transportation, so that they are not likely to become crumpled or creased.

The side bodies are each provided, on the remote edge thereof from that connected hingedly to the mid-body 1, closure flaps 15 which are provided with closure hooks 16 allowing mutual tightening of the side bodies for holding them closed in practice against the mid-body 1; the flaps are sized to come in mutual contact, in the closed position thereof, by overlapping at the middle portion of the body 1.

Expediently, below and adjacent to the area accommodating the recess 2, there are provided openable drawers 20 having gripping tabs 21 which, with the suitcase closed, are covered by the overlapping closure flaps 15.

On the side edges of the side bodies 10, preferably on the edges having the closure flaps 15, rubber rest feet 45 may be provided; on the opposed face, there is advantageously provided an auxiliary handgrip 36 which facilitates handling of the suitcase, for example when it is to be placed on the roof rack of a motor vehicle or in other means of transportation.

It should be added to the foregoing that the recess 2 may be sized to contain a breifcase, bag, or small case therein, as indicated at 50, which may be made purposely for this suitcase, and accordingly, have a size substantially correpsonding to the space left available by the recess 2, but may also be any conventional case, holdall or the like.

At the upper portion of the recess 2, there are provided crosspieces 60 which serve in practice as auxiliary handgrips to facilitate transportation of the suitcase on its casters 6.

Furthermore, on the crosspieces 60 there may be mounted a closure strap for holding the briefcase within the recess 2 when, for example, the suitcase is left at a baggage room or the like.

It should be further added to the foregoing that the recess 2 could be made so as to only span a small mid-portion of the body 1, to give access to the handgrip 4 only, and that the suitcase could have situated around that recess, for example, additional drawers or the like elements.

It may be appreciated from the foregoing that the invention achieves its objects, and in particular that the suitcase structure of this invention has the important peculiarity of including a handgrip formed on the recess bottom, thereby the user can easily carry the suitcase whilst holding it in an upright manner, with the suits, clothes or whatever has been introduced into the suitcase, hanging from a respective hanger, and consequently with the certainty of not creasing or crumpling the suits themselves, this being also true with the suitcase resting on a larger face thereof.

Furthermore, by constructing the suticase with three volumes separated from one another, it becomes possible to provide in the mid-body, drawers which allow the personal belongings of the user to be kept orderly therein.

Another important aspect of the invention is that the suitcase can be converted in practice into a transportable wardrobe, with the advantage that the user is not, in the event of short stays, to preliminarly remove all of the garments from the suitcase, but merely, by resting the suitcase as shown in FIG. 2, to use the suitcase as a proper wardrobe, removing the items contained therein only when required.

In practicing the invention, the material used, so long as compatible with the specific use, and the dimensions and contingent shapes, may be any ones metting occasional requirements.

I claim:

1. A suitcase comprising a substantially parallelepipedal flattened elongated mid-body having first and second opposite integral, substantially parallel larger walls defining first and second, opposite, substantially parallel larger faces, a front wall defining a front face extending between said larger faces and substantially at right angle thereto, a rear wall defining a rear face extending between said larger faces substantially parallel and opposite to said front face, a rest face extending among said larger, front and rear faces substantially at right angle thereto and a recessed face substantially parallel and opposite to said rest face, said larger walls extending from said recessed to said rest faces; first and second side bodies extending laterally of said first and second larger faces, respectively, each of said side bodies having a large lateral face substantially parallel, in one closed condition of the suitcase, to said larger faces of said mid-body and four side faces arranged substantially at right angle to said lateral face and defining front, rear, rest and suspension walls substantially aligned, in the closed condition of the suitcase, to said front, rear, rest and recessed faces, and defining on their interior compartments open toward said larger faces of said mid-body, said mid-body and side bodies defining together a suitcase depth in the closed condition of the suitcase; hinge means connecting said rear walls of said first and second side bodies to said rear face of said mid-body, said recessed face of said mid-body having a recess defining a depressed bottom wall; a handgrip on said bottom wall, said handgrip being located at a middle position of said suitcase depth, said mid-body having a plurality of drawers comprised between said bottom wall and said rest face, extending between said rear face and said front face in the closed condition thereof and extractable at said front face; a closure element affixed to at least one of said side bodies at said front wall thereof and extending between said front walls thereby at least partially covering, in said closed condition, said front face of said mid-body, said compartments having each, at a portion thereof near said suspension wall, a holding rod for the suspension of clothes hangers thereon.

2. A suitcase according to claim 1, wherein said closure element comprises first and second closure flaps affixed respectively at said first and second side bodies at the front walls thereof, each said flap projecting beyond the respective front wall for such a width as to mutually contact in said closed condition and having such a length as, in said closed condition, to cover said front face at least at said drawers, said closure flaps carrying mutually cooperating closure hooks.

3. A suitcase comprising a substantially parallelepipedal flattened elongated mid-body having first and second opposite integral, substantially parallel larger faces, a front face extending between said larger faces and substantially at right angle thereto, a rear face extending between said larger faces substantially parallel and opposite to said front face, a rest face extending among said larger, front and rear faces substantially at right angle thereto and a recessed face substantially parallel and opposite to said rest face; first and second side bodies extending laterally of said first and second larger faces, respectively, each of said side bodies having a large lateral face substantially parallel, in the closed condition of the suitcase, to said larger faces of said mid-body and four side faces arranged substantially at right angle to said lateral face and defining front, rear, rest and suspension walls substantially aligned, in the closed condition of the suitcase, to said front, rear, rest and recessed faces, and defining on their interior compartments open toward said larger faces of said mid-body, said mid-body and side bodies defining together a suitcase depth in the closed condition of the suitcase; hinge means connecting said rear walls of said first and second side bodies to said rear face of said mid-body, said recessed face of said mid-body having a recess defining a depressed bottom wall; a handgrip on said bottom wall, said handgrip being located at a middle position of said suitcase depth, said mid-body having a plurality of drawers comprised between said bottom wall and said rest face, extending between said rear face and said front face in the closed condition thereof and extractable at said front face; a closure element comprising first and second closure flaps affixed respectively at said first and second side bodies at the front walls thereof, each flap projecting beyond the respective front wall for such a width as to mutually contact in said closed condition and having a length as to cover, in said closed condition, said front face at least at said drawers, said closure flaps carrying mutually cooperating closure hooks and defining rest feet, and said compartments having each, at a portion thereof near said suspension wall, a holding rod for the suspension of clothes hangers thereon.

4. A suitcase comprising a substantially parallelepipedal flattened elongated mid-body having first and second opposite integral, substantially parallel larger faces, a front face extending between said larger faces and substantially at right angle thereto, a rear face extending between said larger faces substantially parallel and opposite to said front face, a rest face extending among said larger, front and rear faces substantially at right angle thereto and a recessed face substantially parallel and opposite to said rest face; first and second side bodies extending laterally of said first and second larger faces, respectively, each of said side bodies having a large lateral face substantially parallel, in the closed condition of the suitcase, to said larger faces of said mid-body and four side faces arranged substantially at right angle to said lateral face and defining front, rear, rest and suspension walls substantially aligned, in the closed condition of the suitcase, to said front, rear, rest and recessed faces, and defining on their interior compartments open toward said larger faces of said mid-body, said mid-body and side bodies defining together a suitcase depth in the closed condition of the suitcase; hinge means connecting said rear walls of said first and second side bodies to said rear face of said mid-body, said recessed face of said mid-body having a recess defining a depressed bottom wall; a handgrip on said bottom wall, said handgrip being located at a middle position of said suitcase depth, said mid-body having a plurality of drawers comprised between said bottom wall and said rest face, extending between said rear face and said front face in the closed condition thereof and extractable at said front face; a closure element affixed to at least one of said side bodies at said front wall thereof and extending between said front walls thereby at least partially covering, in said closed condition, said front face of said mid-body, said compartments having each, at a portion thereof near said suspension wall, a holding rod for the suspension of clothes hangers thereon and first and second crosspieces extending in said recess between said larger faces substantially at corner locations between said recessed face and, respectively, said front and said rear face, thereby defining further handgrips.

5. A suitcase according to claim 3 or 4, further comprising caster wheels at said rest face and said rest walls.

6. A suitcase according to claim 5, wherein said castor wheels are encircled from bell-like bodies formed of elastically compliant material.

7. A suitcase according to claim 3 or 4, wherein said rear face of said mid-body carries a further handgrip.

8. A suitcase according to claim 3 or 4, wherein said recess may removably accommodate therein a case.

9. A suitcase comprising a substantially parallelepipedal flattened elongated mid-body having first and second opposite integral, substantially parallel larger faces, a front face extending between said larger faces and substantially at right angle thereto, a rear face extending between said larger faces substantially parallel and opposite to said front face, a rest face extending among said larger, front and rear faces substantially at right angle thereto and a recessed face substantially parallel and opposite to said rest face; first and second side bodies extending laterally of said first and second larger faces, respectively, each of said side bodies having a large lateral face substantially parallel, in the closed condition of the suitcase, to said larger faces of said mid-body and four side faces arranged substantially at right angle to said lateral face and defining front, rear, rest and suspension walls substantially aligned, in the closed condition of the suitcase, to said front, rear, rest and recessed faces, and defining on their interior components open toward said larger faces of said mid-body, said mid-body and side bodies defining together a suitcase depth in the closed condition of the suitcase; hinge means connecting said rear walls of said first and second side bodies to said rear face of said mid-body, said recessed face of said mid-body having a recess defining a depressed bottom wall; a handgrip on said bottom wall, said handgrip being located at a middle position of said suitcase depth, said mid-body having a plurality of drawers comprised between said bottom wall and said rest face, extending between said rear face and said front face in the closed condition thereof and extractable at said front face; first and second closure flaps attached to said first and second side bodies, respectively, at the front walls thereof, each flap projecting beyond the respective front wall for such a width as to mutually contact in said closed condition and having a length as to cover, at said closure condition, said front face at least at said drawers, said closure flaps carrying mutually cooperating closure hooks, and said compartments having each, at a portion thereof near said suspension wall, a holding rod for the suspension of clothes hangers thereon; caster wheels at said rest face and said rest walls encircled from bell-like bodies formed of elastically compliant material; a second handgrip at said rear face of said mid-body as well as first and second cross-pieces extending in said recess between said larger faces substantially at corner portions thereof between said recessed face and, respectively, said front and said rear face, thereby defining third and fourth handgrips.

* * * * *